US007543580B1

(12) United States Patent
Oglesby

(10) Patent No.: US 7,543,580 B1
(45) Date of Patent: Jun. 9, 2009

(54) HEATING DEVICE

(75) Inventor: John Paul Oglesby, Carlow (IE)

(73) Assignee: Oglesby & Butler Research & Development Limited, Carlow (IE)

( * ) Notice: Subject to any disclaimer, the term of this patent is extended or adjusted under 35 U.S.C. 154(b) by 1351 days.

(21) Appl. No.: 10/048,019

(22) PCT Filed: Jul. 26, 2000

(86) PCT No.: PCT/IE00/00091

§ 371 (c)(1),
(2), (4) Date: Jun. 3, 2002

(87) PCT Pub. No.: WO01/07173

PCT Pub. Date: Feb. 1, 2001

(30) Foreign Application Priority Data

Jul. 26, 1999 (IE) ..... S990634

(51) Int. Cl.
*B44D 3/16* (2006.01)

(52) U.S. Cl. ..... 126/401; 222/113

(58) Field of Classification Search ..... 126/401; 222/113

See application file for complete search history.

(56) References Cited

U.S. PATENT DOCUMENTS 4,755,073 A 7/1988 Girardin et al.
5,154,322 A * 10/1992 Sim ..... 222/146.2
5,799,648 A * 9/1998 Oglesby et al. ..... 126/414
5,881,924 A 3/1999 Bokros

FOREIGN PATENT DOCUMENTS

EP 0 123 259 A 10/1984
EP 0 235 055 A 9/1987
GB 2 263 243 A 7/1993

* cited by examiner

*Primary Examiner*—Alfred Basichas
(74) *Attorney, Agent, or Firm*—Sughrue Mion, PLLC

(57) ABSTRACT

A glue gun (1) for melting a glue stick (2) comprises a heating device (3) which in turn comprises a main housing (4) having a combustion chamber (6) and a working body member (5) having a heating chamber (20) within which the glue stick (2) is melted. A gas catalytic combustion element (10) in the combustion chamber (6) converts fuel gas to heat for heating the main body member (4) for in turn melting the glue stick (2). Melted glue is dispensed through a dispensing nozzle (25). A cover (30) around the dispensing nozzle (25) forms a pair of exhaust gas passageways (33) on respective opposite sides of the dispensing nozzle (25) for conducting exhaust gases form an exhaust gas port (15) form the combustion chamber (6) to an exhaust gas outlet (34). Heat exchange fins (45, 46) form the passageway (33) into a circuitous tortuous passageway and transfer heat from the exhaust gases into the dispensing nozzle (25) for cooling the exhaust gases to a safe temperature.

20 Claims, 6 Drawing Sheets

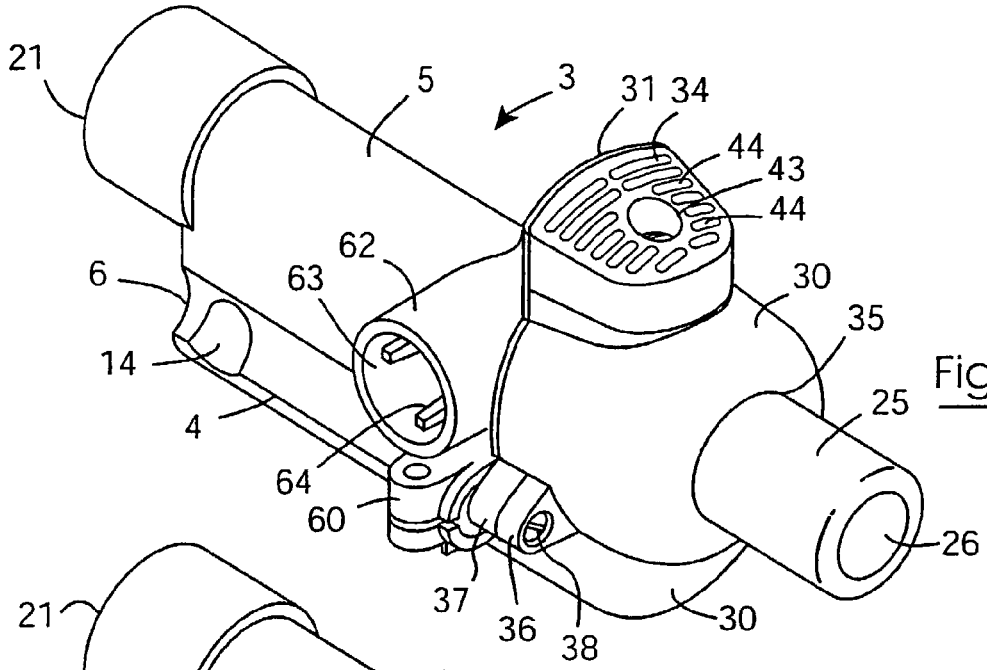
Fig. 2
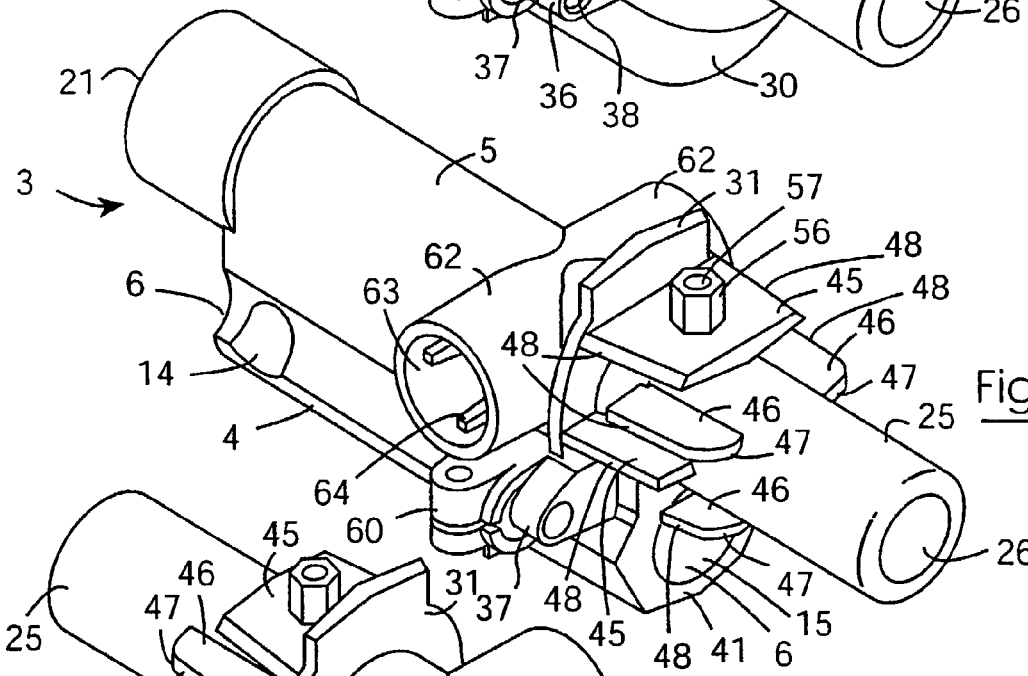
Fig. 5
Fig. 6

HEATING DEVICE

This is a National stage entry under 35 U.S.C. § 371 of PCT Application No. PCT/IE00/00091 filed Jul. 26, 2000; the disclosure of which is incorporated herein by reference.

BACKGROUND OF THE INVENTION

The present invention relates to a heating device, and in particular, to a gas powered heating device, for example, a glue gun or other such device.

Gas powered heating devices comprise a combustion chamber within which gas is converted to heat. The gas may be converted to heat by flame combustion, or catalytic combustion. However, in both cases exhaust gases are exhausted from the combustion chamber. These gases, in general, tend to be at a relatively high temperature, and in many instances for safety reasons in the case of portable appliances, such as hand tools, and domestic appliances, it is undesirable to outlet the exhaust gases to atmosphere at such high temperatures. The temperature of the exhaust gases, may be such as to cause damage, or injury such as burns to an individual. For example, in the case of a gas powered hot melt glue gun exhaust gases at a relatively high temperature exiting from an exhaust outlet port may damage the article, for example, furniture or the like on to which the melted glue is being dispensed. Additionally, unless care is taken by a user the hot exhaust gases exiting from an exhaust outlet port of a glue gun, may inflict serious burns to the user, should a user inadvertently place a hand or other part of the body adjacent the exhaust outlet port in the path of the exhaust gases. As well as the potential dangers of exhaust gases of excessively high temperatures, exhausting such gases at high temperatures is inefficient, since the heat contained in the exhaust gases is lost to atmosphere with no benefit. Similar problems arise with other gas powered heating devices.

There is therefore a need for a heating device which overcomes these problems.

SUMMARY OF THE INVENTION

The present invention is directed towards providing such a heating device.

According to the invention there is provided a heating device comprising a main housing defining a combustion chamber within which fuel gas is converted to heat for heating the main housing, an exhaust gas port from the combustion chamber for exhausting burnt gases therefrom, and a working body member of heat conductive material in heat conducting engagement with the main housing for receiving heat therefrom, wherein a heat exchange means communicating with the exhaust gas port for receiving exhaust gases therefrom is located adjacent the working body member for transferring heat from the exhaust gases to the working body member for reducing the temperature at which the exhaust gases exit from the heating device.

Preferably, the heat exchange means is in heat conducting engagement with the working body member.

In one embodiment of the invention the heat exchange means comprises a plurality of spaced apart heat exchange fins extending from the working body member. Preferably, the heat exchange fins define an exhaust gas passageway, the exhaust gas passageway extending between the exhaust gas port and an exhaust gas outlet for receiving and conducting the exhaust gases from the exhaust gas port past the heat exchange fins to the exhaust gas outlet. Advantageously, the heat exchange fins define a circuitous exhaust gas passageway. Ideally, the heat exchange fins extend from the working body member in a staggered formation for forming the circuitous exhaust gas passageway. The heat exchange fins may be parallel or inclined to each other.

In another embodiment of the invention a cover is provided around the working body member adjacent the heat exchange fins for defining with the working body member and the heat exchange fins, the exhaust gas passageway.

Preferably, the heat exchange fins extend on respective opposite sides of the working body member for defining a pair of passageways extending on both sides of the working body member. Advantageously, the respective passageways merge adjacent the exhaust gas port and adjacent the exhaust gas outlet.

In one embodiment of the invention the main housing is an elongated main housing defining an elongated combustion chamber extending from an upstream end to a downstream end, the exhaust gas port being located adjacent the downstream end, the heat exchange means being located on the working body member adjacent the downstream end of the main housing.

In another embodiment of the invention the working body member extends longitudinally along the main housing from the upstream end to the downstream end thereof.

In a further embodiment of the invention a portion of the working body member extends in a downstream direction beyond the downstream end of the main housing, and the heat exchange means is located adjacent the portion of the working body member extending downstream beyond the working body member.

In one embodiment of the invention the working body member defines a heating chamber for receiving and melting hot melt glue therein, and a dispensing nozzle extends from the working body member communicating with the heating chamber for receiving and dispensing melted glue therefrom. Preferably, the heating chamber is an elongated heating chamber extending between an upstream end and a downstream end, the dispensing nozzle extending in a generally downstream direction from the downstream end of the working body member. Advantageously, the heat exchange means is located adjacent the dispensing nozzle. Ideally, the heat exchange means extends around the dispensing nozzle in a direction transversely of the upstream/downstream direction of the heating chamber.

In another embodiment of the invention the dispensing nozzle extends axially from the working body member relative to the heating chamber, and preferably, the dispensing nozzle extends co-axially with the heating chamber from the working body member.

In one embodiment of the invention a glue receiving inlet is provided at the upstream end of the heating chamber for receiving glue into the heating chamber in an elongated stick form. Preferably, the glue receiving inlet receives the glue stick co-axially with the heating chamber.

In another embodiment of the invention the working body member is located relative to the main housing so that the heating chamber and the combustion chamber extend parallel to each other.

In a further embodiment of the invention a fuel gas inlet is located at the upstream end of the combustion chamber for receiving fuel gas for converting to heat in the combustion chamber.

In another embodiment of the invention a gas catalytic combustion element is located in the combustion chamber for converting fuel gas to heat.

In one embodiment of the invention the heat exchange means is adapted for reducing the temperature of the exhaust gases exiting the exhaust gas outlet to a temperature approximately similar to the temperature of the working body member.

In one embodiment of the invention the heat exchange means is adapted for reducing the temperature of the exhaust gases exiting the exhaust gas outlet to a temperature approaching the temperature of the working body member.

In another embodiment of the invention the heat exchange means is adapted for reducing the temperature of the exhaust gases exiting the exhaust gas outlet to a temperature just slightly above the temperature of the working body member adjacent the heat exchange means. Preferably, the heat exchange means is adapted for reducing the temperature of the exhaust gases exiting the exhaust gas outlet to a temperature not greater than 15° C. above the temperature of the working body member adjacent the heat exchange means. Advantageously, the heat exchange means is adapted for reducing the temperature of the exhaust gases exiting the exhaust gas outlet to a temperature not greater than 10° C. above the temperature of the working body member adjacent the heat exchange means. Ideally, the heat exchange means is adapted for reducing the temperature of the exhaust gases exiting the exhaust gas outlet to a temperature not greater than 5° C. above the temperature of the working body member adjacent the heat exchange means.

Additionally, the invention provides a glue gun wherein the glue gun comprises the heating device according to the invention.

The advantages of the invention are many. The heating device according to the invention is a relatively efficient heating device and in particular, is a relatively safe heating device. By virtue of the fact that exhaust gases exit from the exhaust gas outlet at a relatively low temperature, there is little danger of damage to articles which are adjacent the device in use, and furthermore, there is little danger of injury or burns to a user of the heating device. The advantages of the invention are largely achieved by the provision of the heat exchange means for transferring heat from the exhaust gases between the exhaust gas port of the combustion chamber and the exhaust gas outlet from the heating device. The fact that the heat exchange means is in heat conducting engagement with the main body member allows the temperature of the exhaust gases to be reduced to a temperature substantially similar to that of the main body member, and in general to a temperature just slightly above the temperature of the working body member. For example, where the heating device is provided as a glue gun for melting and dispensing hot melt glue, the temperature of the main body member is typically in the order of 200° C. The temperature of the exhaust gases exiting the exhaust gas port from the combustion chamber can be as high as 600° C. to 800° C. Thus, it is possible to reduce the temperature of the exhaust gases by the provision of the heat exchange means from a temperature in the range of 600° C. to 800° C. down to a temperature just slightly greater than 200° C., thus achieving a temperature drop in the exhaust gases in the order of 400° C. to 600° C. The heating device may also be provided as a glue gun for melting lower temperature glues, and the temperature of the working body member may be as low as 100° C. to 140° C. In such cases, the heat exchange means would reduce the temperature of the exhaust gases by an even greater temperature drop down to approximately 100° C. to 140° C. from the original exhaust gas port temperature of the order of 600° C. to 800° C. Additionally, should the heating device be provided for a hot plate sandwich toaster, typically, the hot plates of such sandwich toasters are maintained at a temperature of approximately 200° C. Similar temperature reductions are achieved in the exhaust gases when the heating device is used in a hot plate sandwich toaster. In such cases the working body member forms the hot plate or hot plates of the hot plate toaster, and since the hot plate normally operates at a temperature of the order of 200° C. the exhaust gases issuing from the hot plate toaster would be just slightly greater than 200° C.

Additionally, the fact that the heat exchange means forms a circuitous passageway through which the exhaust gases pass, significantly increases the area of contact between the exhaust gases and the heat exchange means. This, thus, increases the heat transfer efficiency from the exhaust gases to the heat exchange means and in turn to the working body member, thus enhancing the cooling affect of the heat exchange means on the exhaust gases. By providing the heat exchange means in the form of heat exchange fins further enhances the area of contact between the heat exchange means and the exhaust gases, thereby further enhancing the heat transfer efficiency, and in turn the cooling affect of the heat exchange means on the exhaust gases. Accordingly, the greater the temperature by which the exhaust gases are reduced, the greater will be the heat transfer from the exhaust gases to the working body member, and thus, as well as providing a safe heating device, the invention also provides an efficient heating device.

In the embodiment of the invention when the heating device is provided for use in a glue gun further advantages are achieved. By virtue of the fact that heat is transferred from the exhaust gases through the heat exchange means into the dispensing nozzle additional heat is provided to the dispensing nozzle for maintaining the temperature of the melted glue at its melt temperature.

The transfer of heat from the exhaust gases as well as enhancing the safety of the heating device also enhances its efficiency, due to the fact that heat which would otherwise be lost in the exhaust gases is transferred back into the heating device.

Additionally, where the heating device is used as a heating device in a glue gun, a particularly efficient and safe glue gun is provided. Needless to say the heating device may be used in a hot plate sandwich toaster, a hot plate for cooking or warming food, griddle plates for cooking food, a clothes smoothing iron or the like, and similar efficient and safe devices are provided.

BRIEF DESCRIPTION OF THE DRAWINGS

The invention will be more clearly understood from the following description of a preferred embodiment thereof which is given by way of example only with reference to the accompanying drawings, in which:

FIG. 2 is a perspective view of the heating device of FIG. 1, FIG. 5 is a perspective view of a portion of the heating device of FIG. 1 from the front end, FIG. 6 is a perspective view of the portion of the heating device of FIG. 5 from the rear end.

DETAILED DESCRIPTION OF THE INVENTION

Figure 1:
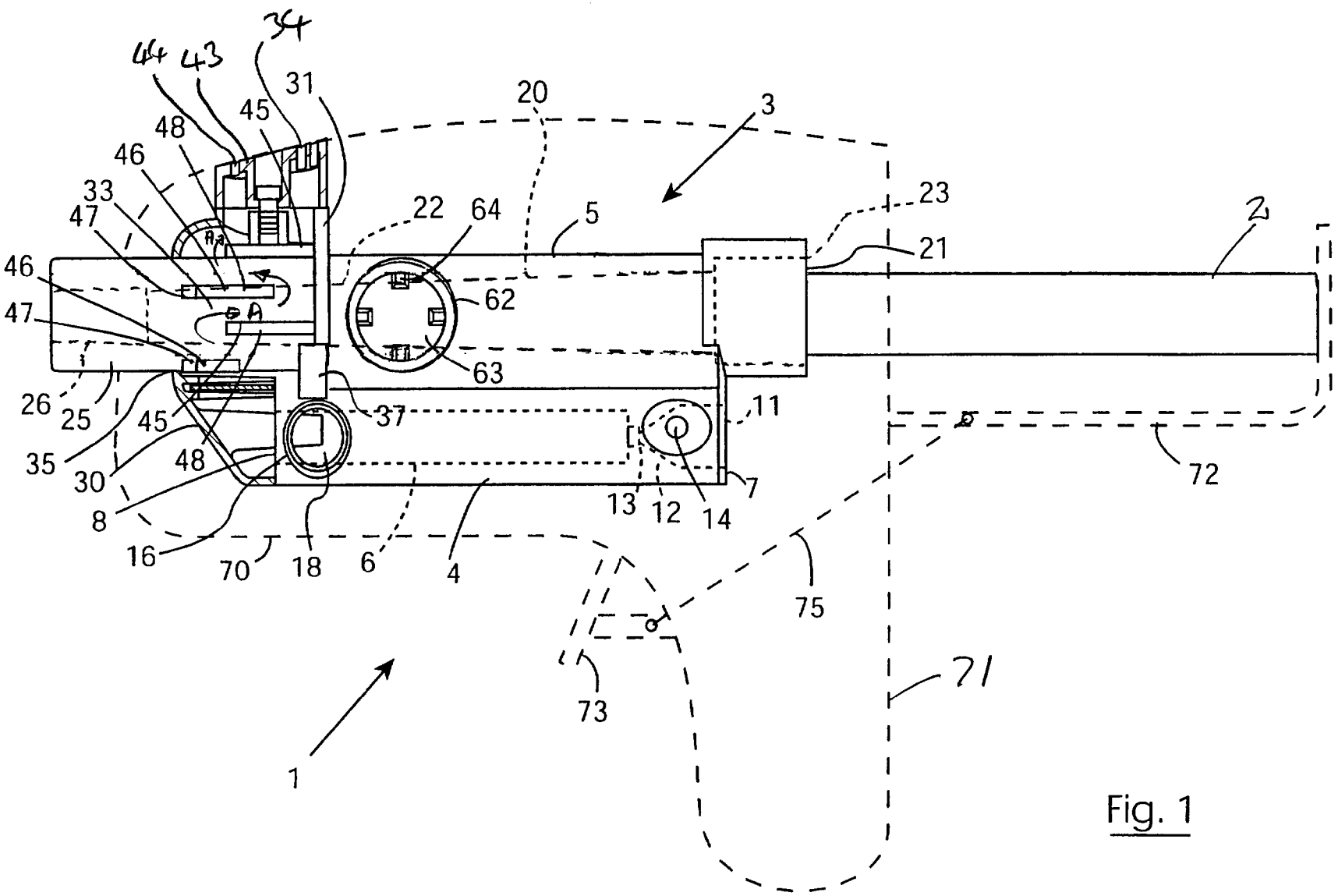
FIG. 1 is a side elevational view of a glue gun according to the invention comprising a heating device also according to the invention for heating, melting and dispensing hot melt glue.

Referring to the drawings there is illustrated a hand held glue gun according to the invention indicated generally by the reference numeral 1 which is illustrated in schematic form. Such glue guns will be well known to those skilled in the art. In this embodiment of the invention the glue gun 1 is of the type which is suitable for melting an elongated stick 2 of hot melt glue and dispensing the heated melted glue. The glue gun 1 comprises a heating device also according to the invention and indicated generally by the reference numeral 3 within which the glue stick 2 is melted and from which the melted glue is dispensed as will be described below. An outer shell type housing 70 which is illustrated in broken lines only in FIG. 1 surrounds the heating device 3. The housing 70 may be of any suitable material, for example, a high temperature resistant plastics material, and is of gun shape having a handle portion 71 for holding of the glue gun 1. An urging mechanism comprising a carrier 72 extends from the housing 70 and carries the glue stick 2 for urging the glue stick 2 into the heating device 3 for melting thereof. A trigger mechanism 73 in the handle portion 71 is connected to the carrier 72 by a ratchet mechanism 75 for urging the carrier 72 towards the heating device 3 for in turn urging the glue stick 2 into the heating device 3 by operating the trigger mechanism 75. Such mechanisms for urging a glue stick into a heating device of a glue gun will be well known to those skilled in the art.

Figure 11:
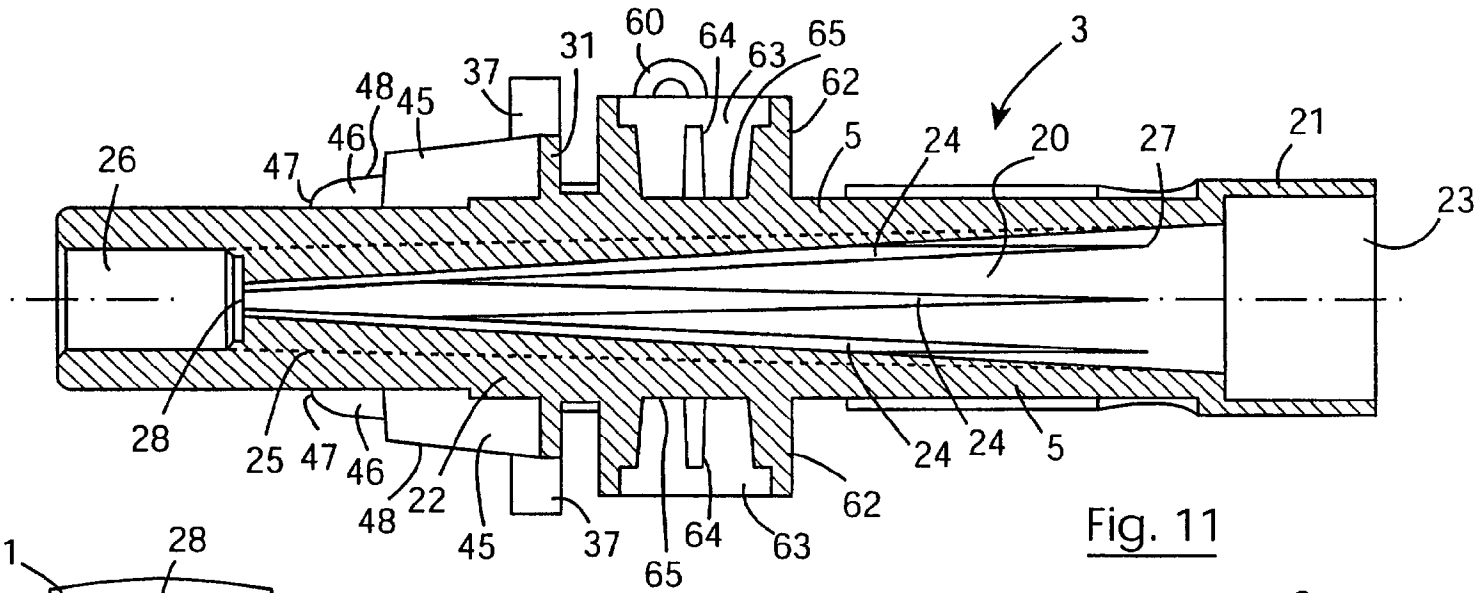
FIG. 11 is a cross-sectional plan view of the portion of the device of FIG. 5 on the line XI-XI of FIG. 10.
Figure 9:
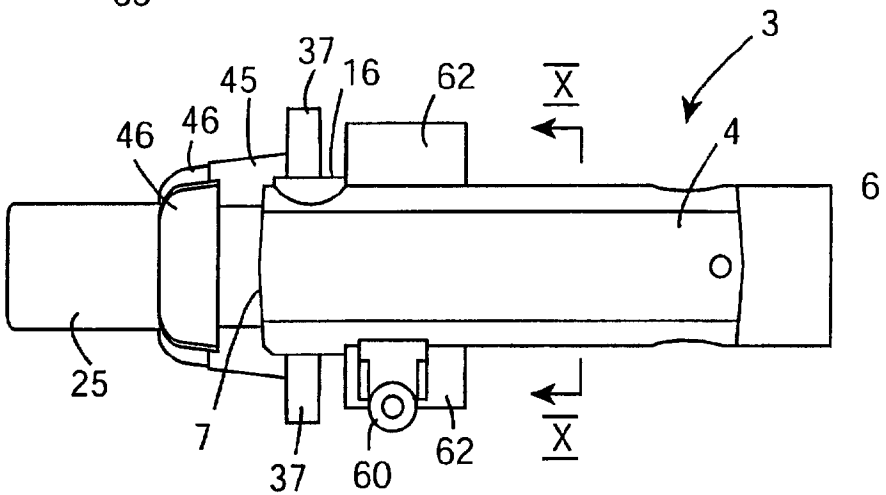
FIG. 9 is an underneath plan view of the portion of the heating device of FIG. 5.
Figure 10:
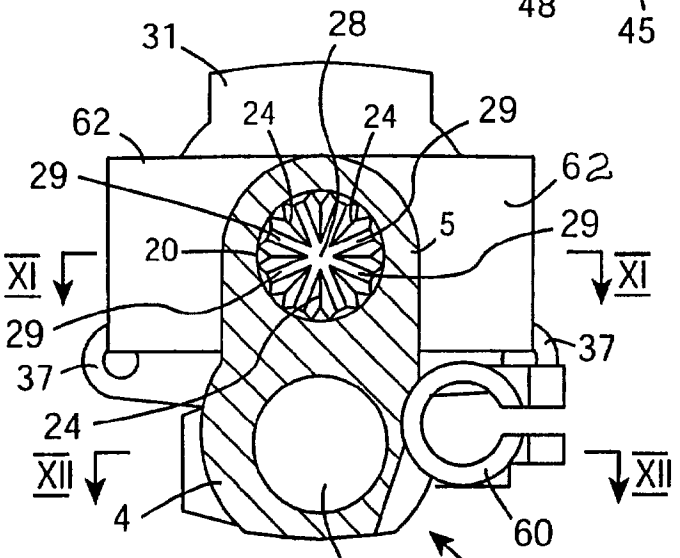
FIG. 10 is a rear end cross-sectional view of the portion of the device of FIG. 5 on the line X-X of FIG. 9.

The heating device 3 comprises a main housing 4 and a working body member 5 both of which are integrally formed by di-casting and are of heat conductive material, namely, aluminium. The main housing 4 defines an elongated combustion chamber 6 of circular transverse cross-section, which extends from an upstream end 7 to a downstream end 8, see FIG. 11. A gas catalytic combustion element 10 is located in the combustion chamber 6 for converting fuel gas to heat by a catalytic reaction. The catalytic combustion element 10 in this embodiment of the invention is provided by a perforated metal carrier which is formed into a tubular shape defining an elongated hollow core 9, and is located co-axially in the combustion chamber 6. The carrier is coated with appropriate catalytic material, typically, a precious metal. A gas inlet 11 for receiving fuel gas is located at the upstream end 7 of the combustion chamber 6, and a venturi mixer 12 is located adjacent the gas inlet 11 for mixing the fuel gas with air for delivery into the combustion chamber 6 through an inlet port 13. Air is drawn into the venturi mixer 12 through a pair of air inlet ports 14 located on respective opposite sides of the main housing 4. A gas jet (not shown) is provided in the inlet port 13 for delivering the fuel gas/air mixture into the combustion chamber 6. The downstream end 8 of the combustion chamber 6 is open and forms an exhaust gas port 15 from which exhaust gases are exhausted from the combustion chamber 6. An inspection port 16, which is closed by a lens 18 permits inspection of the combustion chamber 6 to determine if combustion is taking place.

The working body member 5 defines an elongated heating chamber 20 of circular transverse cross-section for receiving the hot melt glue in stick form and for heating and melting the glue. The heating chamber 20 extends parallel to the combustion chamber 6 from an upstream end 21 adjacent the upstream end 7 of the combustion chamber 6 to a downstream end 22 which is adjacent the downstream end 8 of the combustion chamber 6, and is also adjacent the exhaust gas port 15. A glue accommodating inlet 23 to the heating chamber 20 at the upstream end 21 accommodates a glue stick into the heating chamber 20. A portion of the working body member 5 extends in a downstream direction beyond the exhaust gas port 15, and forms a dispensing nozzle 25 through which heated melted glue is dispensed.

The dispensing nozzle 25 extends co-axially from the heating chamber 20 and communicates therewith for dispensing the heated melted glue from the heating chamber 25.

The heating chamber 20 tapers gradually from the inlet 23 to the downstream end 22 and into the dispensing nozzle 25. Eight glue engaging ribs 24 which are equi-spaced circumferentially around the heating chamber 20 extend radially inwardly into the heating chamber 20 for engaging the glue stick 2 in the heating chamber 20 for transferring heat into the glue stick 2 for melting thereof, and in particular for transferring heat into the centre of the glue stick 2 for ensuring melting of the central core of the glue stick 2. The glue engaging ribs 24 extend longitudinally along the heating chamber 20 from an upstream position 27 to the downstream end 22 of the heating chamber 20 and converge from the upstream position 27 to the downstream end 22 to define a central outlet 28 in the dispensing nozzle 25 for accommodating melted glue into an outlet bore 26 of the dispensing nozzle 25. The outlet bore 26 is co-axial with the heating chamber 20. The glue engaging ribs 24 at the downstream end 22 as well as defining the central outlet 28 also define radial openings 29 extending from the central outlet 28 for similarly accommodating melted glue into the outlet bore 26. The outlet bore 26 is threaded for selectively receiving a dispensing jet (not shown) of the appropriate size and type depending on the type of output glue stream required. Such dispensing jets will be well known to those skilled in the art.

A cover 30 extends around the dispensing nozzle 25 and co-operates with a flange 31 extending around the working body member 5 adjacent the dispensing nozzle 25 for forming a pair of exhaust gas passageways 33 on respective opposite sides of the dispensing nozzle 25 for conducting exhaust gases from the exhaust gas port 15 to an exhaust gas outlet 33. An opening 35 through the cover 30 accommodates the dispensing nozzle 25 therethrough. A pair of lugs 36 extending from the cover 30 co-operate with a pair of corresponding lugs 37 extending from the flange 31 for securing the cover 30 to the working body member 5 and in turn to the main housing 4 by securing screws 38. Edges 39 and 40 of the cover 30 co-operate with the flange 31 and an end face 41 of the main housing 4 for sealably securing the cover 30 to the working body member 5 and the main housing 4 for sealing the exhaust gas passageways 33. An opening 42 in the cover 30 accommodates a louvered member 43 having louver slots 44 which form the exhaust gas outlet 34.

Figure 3:
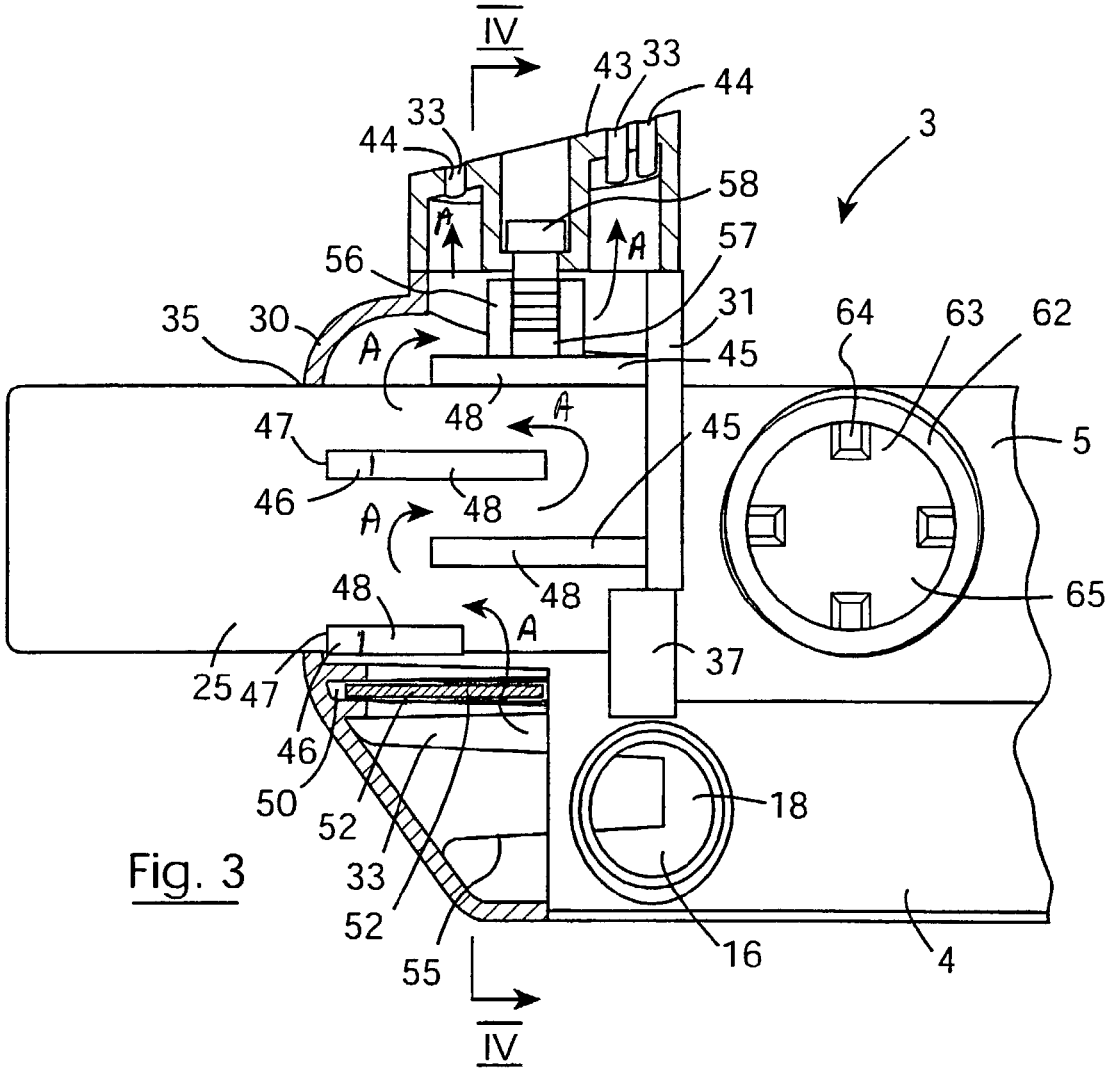
FIG. 3 is a partly cross-sectional side elevational view of a portion of the heating device of FIG. 1.
Figure 12:
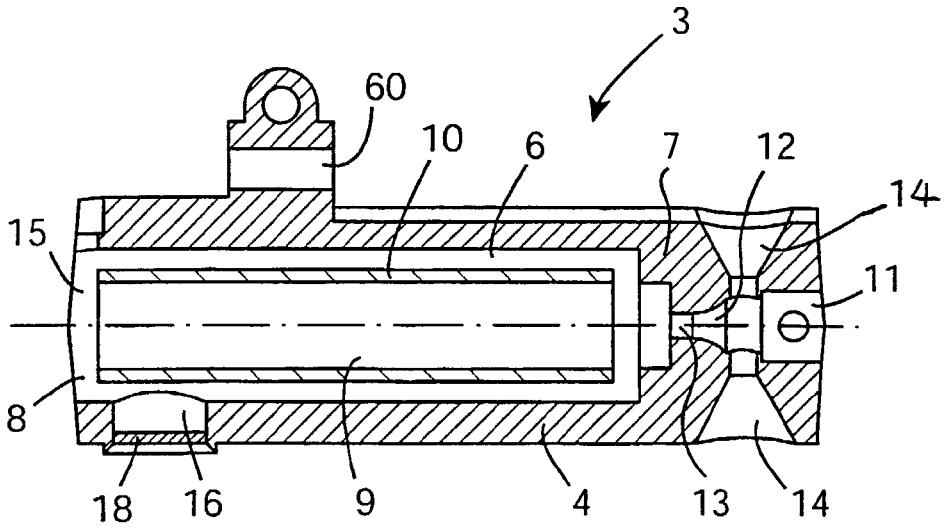
FIG. 12 is a cross-sectional plan view of the portion of the device of FIG. 5 on the line XII-XII of FIG. 10.
Figure 4:
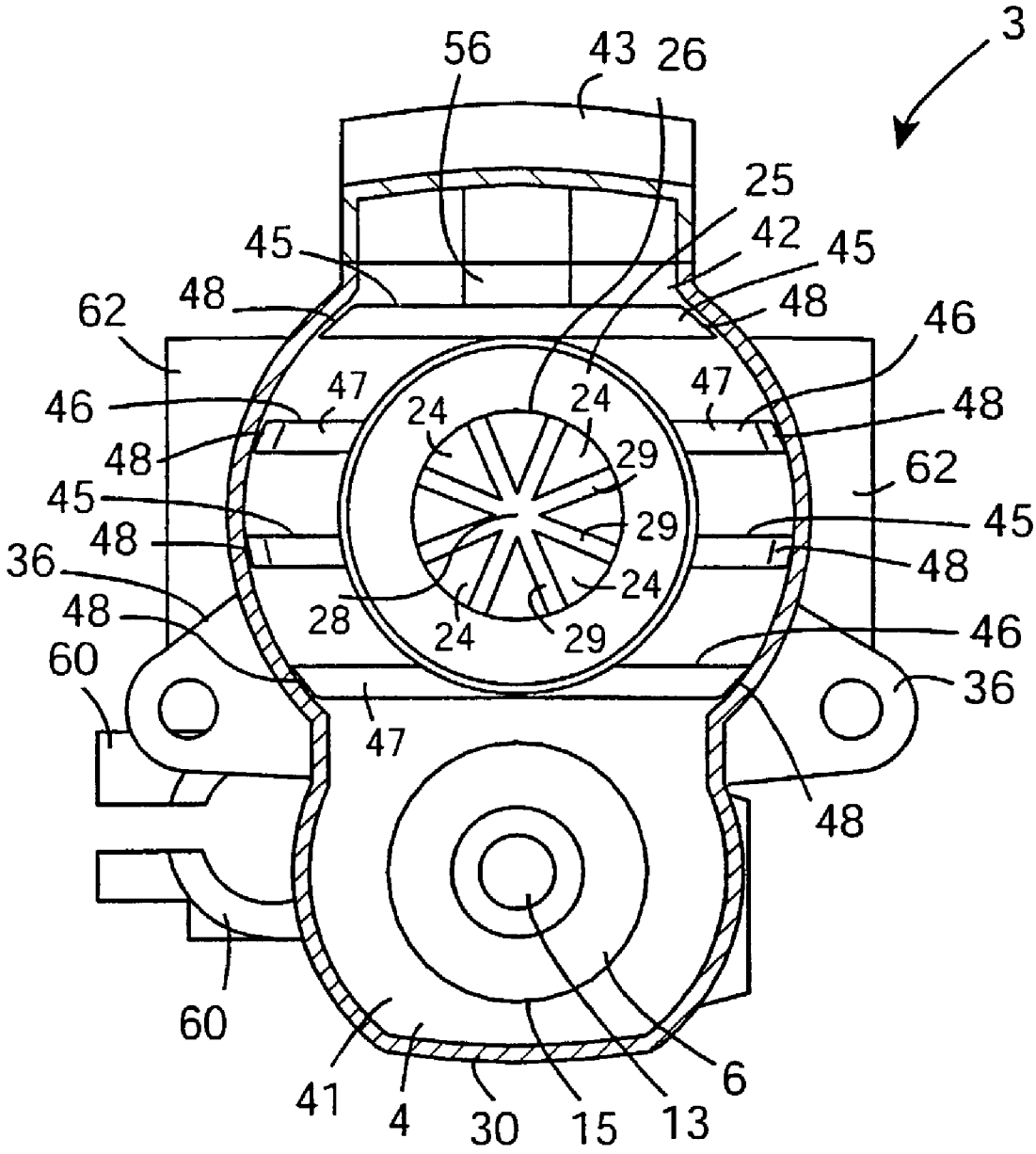
FIG. 4 is a cross-sectional front elevational view of the heating device of FIG. 1 on the line IV-IV of FIG. 3.
Figure 7:
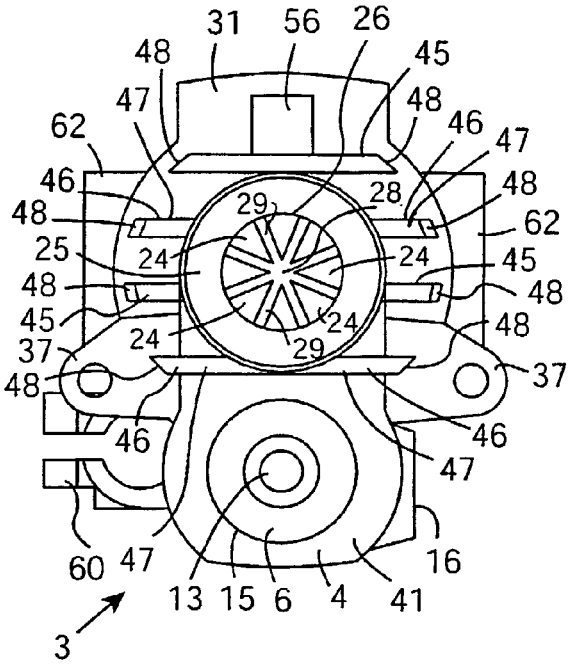
FIG. 7 is a front end elevational view of the portion of the heating device of FIG. 5.
Figure 8:
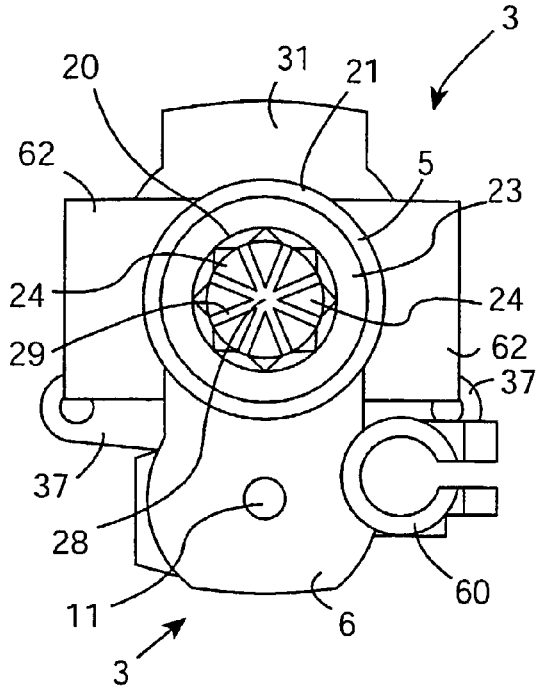
FIG. 8 is a rear end elevational view of the portion of the heating device of FIG. 5.
Figure 14:
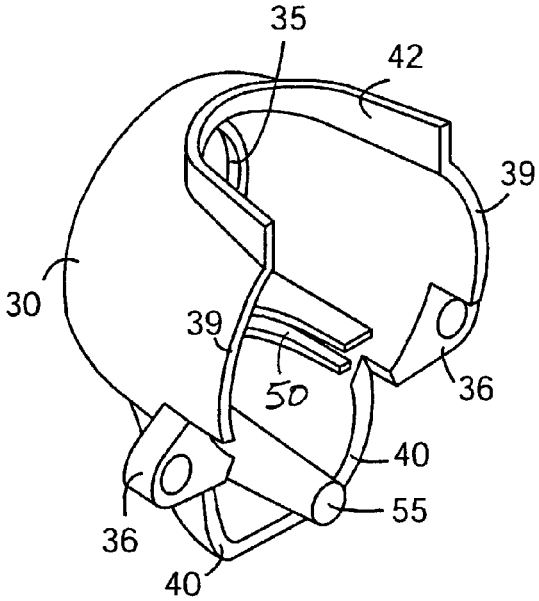
FIG. 14 is a rear perspective view of the portion of FIG. 13 of the heating device of FIG. 1.
Figure 13:
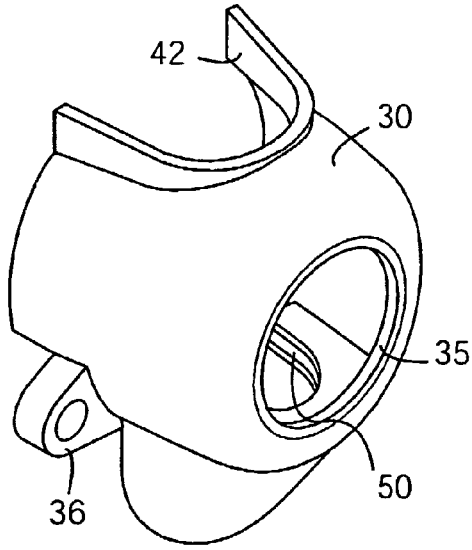
FIG. 13 is a front perspective view of another portion of the heating device of FIG. 1.

A heat exchange means for transferring heat from the exhaust gases passing through the exhaust gas passageways 33 into the dispensing nozzle 25, for in turn cooling the exhaust gases to a relatively safe temperature comprises a plurality of heat exchange fins 45 and 46 extending from the dispensing nozzle 25 into the exhaust gas passageways 33. The heat exchange fins 45 and 46 extend parallel to each other, and are of aluminium formed integrally with the dispensing nozzle 25, the working body member 5 and the main housing 4 and extend transversely of the dispensing nozzle 25 from either side thereof. The heat exchange fins 45 and 46 are staggered relative to each other for forming the exhaust gas passageways 33 into circuitous passageways 33 for conducting the exhaust gases from the exhaust gas port 15 to the exhaust gas outlet 34 along exhaust gas passageways 33 on respective opposite sides of the dispensing nozzle 25 in the direction of the arrows A, see FIG. 3. The heat exchange fins 45 extend from the dispensing nozzle 25 and also from the flange 31, while the heat exchange fins 46 extending from the dispensing nozzle 25 are located so that ends 47 of the heat exchange fins 46 abut the cover 30 so that the respective fins 45 and 46 together form the circuitous passageways 33. Side edges 48 of the heat exchange 45 and 46 also abut the cover 30 for likewise forming the circuitous passageways 33.

A receiving slot 50 in the cover 30 receives a wire mesh flame trap 52 which is located between the exhaust gas port 15 and the dispensing nozzle 25 where the exhaust gas passageways 30 merge for preventing any danger of a flame passing through the passageway 33, for example, during initial flame ignition of the fuel gas/air mixture for initially raising the temperature of the catalytic combustion element to its ignition temperature. A spigot 55 extends from the cover 30 through the exhaust gas port 15 and into the combustion chamber 6 at the downstream end thereof for distributing the fuel gas/air mixture within the combustion chamber 6 and through the catalytic combustion element 10 for ensuring good dispersion of the fuel gas/air mixture through the catalytic combustion element 10 for in turn maximising conversion of the fuel gas/air mixture to heat. The diameter of the spigot 55 is such that the spigot 55 extends through the hollow core 9 of the combustion element 10. A boss 56 mounted on the uppermost heat exchange fin 45 is provided with a threaded bore 57 for receiving a screw 58 for securing the louvered member 43 in the opening 42 of the cover 30, when the cover 30 is assembled to the working body member 5 and the main housing 4.

A mounting bracket 60 extending from the main housing 4 to one side thereof is provided for securing the trigger mechanism 75 to the heating device 3 for urging the glue stick 2 into and through the heating chamber 20. Mounting bosses 62 extend on respective opposite sides of the working body member 5 and define mounting bores 63 having inwardly extending radial members 64 for receiving and securing the housing 70 to the heating device 3. The bores 63 terminate at 65 in the working body member 5 and do not extend into the heating chamber 20.

A fuel gas reservoir (not shown) is located in the handle 71 of the housing 70 for supplying fuel gas to the gas inlet 11 of the main housing 4. An appropriate pressure regulator, a gas flow regulator and an isolating valve for controlling the flow and pressure of the fuel gas from the reservoir (not shown) to the gas inlet 11 are also located in the handle 71 of the housing 70, but are not illustrated. The arrangement of such a fuel gas reservoir with associated pressure and flow regulators and isolating valves will be well known to those skilled in the art.

In use, a glue stick 2 is inserted into the heating chamber 20 through the glue inlet 23 and is engaged by the carrier 72. The isolating valve (not shown) is operated for delivering fuel gas from the reservoir (also not shown) to the gas inlet 11 of the main housing 4. The fuel gas is ignited in the combustion chamber 6 to burn with a flame for raising the temperature of the gas catalytic combustion element 10 to its ignition temperature, at which stage the flame is extinguished and the catalytic combustion element 10 continues to convert the fuel gas/air mixture to heat. The raising of a catalytic element to its ignition temperature by flame combustion will be well known to those skilled in the art. Heat from the combustion chamber 6 is conducted through the main housing 4 into the working body member 5 and in turn through the glue engaging ribs 24 for melting the glue stick 2 in the heating chamber 20. The heat transfer to the glue stick 2 causes the glue stick 2 to melt adjacent its downstream end towards the downstream end of the heating chamber 20. By operating the trigger mechanism 73 to in turn cause the carrier 72 to urge the glue stick 2 into the heating chamber 20, melted glue in the downstream end of the heating chamber 20 is urged through the central outlet 28 and the radial openings 29 into the outlet bore 26. Continuing urging pressure of the carrier 72 on the glue stick 2 by operating the trigger mechanism 73 continues to urge the melted glue through the outlet bore 26 of the dispensing nozzle 25.

Exhaust gases issuing from the exhaust gas port 15 are conducted through the exhaust gas passageways 33 in the direction of the arrows A to the exhaust gas outlet 34. As the exhaust gases pass through the passageways 33 heat is transferred from the exhaust gases into the dispensing nozzle 25 through the heat exchange fins 45 and 46 for both cooling the exhaust gases prior to the exhaust gases issuing from the exhaust gas outlet 34 and also for providing additional heat to the dispensing nozzle 25.

In this embodiment of the invention the glue gun 1 is suitable for melting hot melt glue at a temperature of the order of 200° C. Accordingly, the working body member 5 is raised to a temperature of the order of 200° C. by heat from the catalytic combustion element conducted through the main housing 4. Exhaust gases from the combustion chamber exit through the exhaust gas port 15 at a temperature between 600° C. and 800° C. The heat exchange fins 45 and 46 cool the exhaust gases between the exhaust gas port 15 and the exhaust gas outlet 34 to a temperature which is only slightly above the temperature of the main body member 5. Thus, the exhaust gases exiting through the exhaust gas outlet 34 are at a temperature not much greater than 200° C., and in general at a temperature of approximately 205° C. to 215° C.

While the heating device has been described as comprising a working body member which forms a heating chamber for melting glue, it is envisaged that the heating device may be provided with any other type of working body member, for example, the working body member may be a working body member for use in a hot plate sandwich toaster with one or two hot plates, and typically with two hot plates. The working body member may also be provided as a hot plate for a smoothing flat iron, or the heating tip of a soldering iron. The working body member may also be provided for heating a curling tongs, or as a hot plate for cooking or warming food, or as a hot plate of a griddle or the like.

While the heating device has been described as being of aluminium, the heating device may be of any other suitable heat conductive material, for example, brass, lead, or any other suitable material. It will also be appreciated that while the heat exchange fins have been described as being located parallel to each other, the heat exchange fins may be inclined at an angle to each other. It is also envisaged that more than one wire mesh flame trap may be provided for trapping flames exiting through the exhaust gas port.

The invention claimed is:

1. A glue gun comprising:

a main housing defining a combustion chamber within which fuel gas is converted to heat for heating the main housing, an exhaust gas port from the combustion chamber for exhausting burnt gases therefrom, a working body member of heat conductive material in heat conducting engagement with the main housing for receiving heat therefrom, the working body member defining an elongated heating chamber for receiving and melting hot melt glue therein, a dispensing nozzle extending from the working body member communicating with the heating chamber for dispensing melted glue therefrom, an exhaust gas passageway located adjacent the dispensing nozzle and extending from the exhaust gas port to an exhaust gas outlet for accommodating exhaust gases from the exhaust gas port to the exhaust gas outlet for transferring heat from the exhaust gases to the dispensing nozzle, and a plurality of spaced apart heat exchange fins in direct heat conducting contact with the dispensing nozzle, and extending directly from the dispensing nozzle into the exhaust gas passageway to form the exhaust gas passageway into a circuitous exhaust gas passageway through which the exhaust gases pass between the exhaust gas port and the exhaust gas outlet for transferring heat from the exhaust gases to the dispensing nozzle.

2. A glue gun as claimed in claim 1 in which the heat exchange fins extend longitudinally along and transversely from the dispensing nozzle.

3. A glue gun as claimed in claim 1 in which the heat exchange fins are formed integrally with the dispensing nozzle.

4. A glue gun as claimed in claim 1 in which the heat exchange fins extend from the dispensing nozzle in a staggered formation for forming the circuitous exhaust gas passageway.

5. A glue gun as claimed in claim 1 in which the heat exchange fins are parallel or inclined to each other.

6. A glue gun as claimed in claim 1 in which the heat exchange fins extend on respective opposite sides of the dispensing nozzle for defining a pair of exhaust gas passageways extending one on each side of the dispensing nozzle.

7. A glue gun as claimed in claim 6 in which the respective exhaust gas passageways merge adjacent the exhaust gas port and adjacent the exhaust gas outlet.

8. A glue gun as claimed in claim 1 in which a cover is provided around at least a portion of the dispensing nozzle adjacent the working body member for defining with the dispensing nozzle and the heat exchange fins each exhaust gas passageway.

9. A glue gun as claimed in claim 1 in which the main housing is an elongated main housing defining the combustion chamber as an elongated combustion chamber and extending from an upstream end to a downstream end, the exhaust gas port being located adjacent the downstream end, and the dispensing nozzle extending from the working body member adjacent the downstream end of the main housing.

10. A glue gun as claimed in claim 9 in which the working body member extends longitudinally along the main housing from the upstream end to the downstream end thereof, and the dispensing nozzle extends in a downstream direction from the working body member beyond the downstream end of the main housing.

11. A glue gun as claimed in claim 9 in which the heating chamber of the working body member extends between an upstream end and a downstream end of the working body member, and the dispensing nozzle extends from the working body member at the downstream end thereof.

12. A glue gun as claimed in claim 9 in which the dispensing nozzle extends axially from the working body member relative to the heating chamber.

13. A glue gun as claimed in claim 11 in which a glue receiving inlet is provided at the upstream end of the working body member for accommodating glue into the heating chamber in an elongated stick form.

14. A glue gun as claimed in claim 1 in which the working body member is located relative to the main housing so that the heating chamber and the combustion chamber extend parallel to each other.

15. A glue gun as claimed in claim 1 in which a fuel gas inlet is located at an upstream end of the combustion chamber for receiving fuel gas for converting to heat in the combustion chamber.

16. A glue gun as claimed in claim 1 in which a gas catalytic combustion element is located in the combustion chamber for converting fuel gas to heat.

17. A glue gun as claimed in claim 1 in which the heat exchange fins are adapted for reducing the temperature of the exhaust gases exiting the exhaust gas outlet to a temperature approximately similar to the temperature of the dispensing nozzle.

18. A glue gun as claimed in claim 1 in which the heat exchange fins are adapted for reducing the temperature of the exhaust gases exiting the exhaust gas outlet to a temperature approaching the temperature of the dispensing nozzle.

19. A glue gun as claimed in claim 1 in which the heat exchange fins are adapted for reducing the temperature of the exhaust gases exiting the exhaust gas outlet to a temperature just slightly above the temperature of the dispensing nozzle adjacent the heat exchange fins.

20. A glue gun as claimed in claim 1 in which the heat exchange fins are adapted for reducing the temperature of the exhaust gases exiting the exhaust gas outlet to a temperature not greater than 50° C. above the temperature of the dispensing nozzle adjacent the heat exchange fins.

* * * * *